US009573046B2

(12) United States Patent
Yu

(10) Patent No.: US 9,573,046 B2
(45) Date of Patent: Feb. 21, 2017

(54) CARD GAME

(75) Inventor: Brian M. Yu, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 676 days.

(21) Appl. No.: 12/901,031

(22) Filed: Oct. 8, 2010

(65) Prior Publication Data

US 2011/0084451 A1 Apr. 14, 2011

Related U.S. Application Data

(60) Provisional application No. 61/250,555, filed on Oct. 11, 2009.

(51) Int. Cl.

| | |
|---|---|
| ***A63F 1/06*** | (2006.01) |
| ***A63F 1/04*** | (2006.01) |
| ***A63F 3/04*** | (2006.01) |
| *A63F 3/00* | (2006.01) |
| *A63F 9/04* | (2006.01) |

(52) U.S. Cl.

CPC ..... *A63F 1/04* (2013.01); *A63F 3/0423* (2013.01); *A63F 1/06* (2013.01); *A63F 1/062* (2013.01); *A63F 2001/0408* (2013.01); *A63F 2001/0458* (2013.01); *A63F 2003/00943* (2013.01); *A63F 2003/00955* (2013.01); *A63F 2003/00958* (2013.01); *A63F 2009/0446* (2013.01); *A63F 2009/0484* (2013.01); *A63F 2009/0488* (2013.01)

(58) Field of Classification Search

CPC ..... A63F 2003/00958; A63F 2003/00955; A63F 2003/00943; A63F 1/062; A63F 2001/0458; A63F 2001/0408; A63F 2009/0446; A63F 2009/0484; A63F 2009/0488; A63F 1/06

USPC ..... 273/272, 299, 146, 285, 287, 302, 308

See application file for complete search history.

(56) References Cited

U.S. PATENT DOCUMENTS

| | | | | |
|---|---|---|---|---|
| 1,034,633 | A | | 8/1912 | Mansfield |
| 1,328,711 | A | * | 1/1920 | Carr ..... 273/285 |
| 1,412,204 | A | | 4/1922 | Derby |
| 1,586,429 | A | | 5/1926 | Kiesling |
| 2,380,106 | A | | 7/1945 | Hilton |
| 3,405,943 | A | | 10/1968 | Marsh et al. |
| 3,606,336 | A | | 9/1971 | Krause |
| 3,724,847 | A | | 4/1973 | Compton |
| 4,055,348 | A | | 10/1977 | Marzoni, Jr. |
| 4,123,051 | A | | 10/1978 | Tsacoyannis |
| 4,171,816 | A | | 10/1979 | Hunt |
| 4,222,561 | A | | 9/1980 | Whitten |
| 4,383,689 | A | | 5/1983 | Kohner et al. |

(Continued)

FOREIGN PATENT DOCUMENTS

GB 2241900 A 9/1991

OTHER PUBLICATIONS

United States Patent and Trademark Office, Office Action for U.S. Appl. No. 13/435,953, May 11, 2016, 8 pages.

*Primary Examiner* — Benjamin Layno
(74) *Attorney, Agent, or Firm* — Kolisch Hartwell, P.C.

(57) ABSTRACT

A card game and method of play is provided. It includes a plurality of game cards and a multifaceted die having a plurality of characters on the faces of said die. A rule set is also provided. It includes a plurality of rules, one of the rules of being that a player identify an adjective that corresponds with one of the plurality of characters on an upturned face of said multifaceted die.

4 Claims, 2 Drawing Sheets

(56) References Cited

U.S. PATENT DOCUMENTS

| | | | | |
|---|---|---|---|---|
| 4,592,553 | A | 6/1986 | Mammen et al. | |
| 4,852,885 | A | 8/1989 | Baratpour et al. | |
| 4,911,448 | A | 3/1990 | Thomas | |
| 4,928,976 | A | 5/1990 | Vano et al. | |
| 4,966,366 | A * | 10/1990 | Mercado-Torres | 273/458 |
| 5,261,671 | A | 11/1993 | Wyatt | |
| 5,558,328 | A | 9/1996 | Krantz | |
| 5,639,094 | A | 6/1997 | Manchester | |
| 6,328,308 | B1 | 12/2001 | Kirby | |
| 6,435,504 | B1 | 8/2002 | Nightingale | |
| 6,520,504 | B2 | 2/2003 | Loder | |
| 6,655,688 | B2 | 12/2003 | Boateng | |
| 6,692,002 | B2 | 2/2004 | Kummer | |
| 6,824,136 | B2 | 11/2004 | Koopman | |
| 6,945,532 | B2 | 9/2005 | Orner et al. | |
| 7,238,107 | B2 | 7/2007 | McVay, III | |
| 7,341,253 | B2 | 3/2008 | Lingenfelser | |
| 7,648,139 | B1 | 1/2010 | Jean | |
| 2005/0070350 | A1* | 3/2005 | McVay, III | 463/7 |
| 2005/0285338 | A1 | 12/2005 | Cusolito | |
| 2008/0187890 | A1 | 8/2008 | Podurgiel | |
| 2010/0148437 | A1 | 6/2010 | Kellond et al. | |

* cited by examiner

CARD GAME

CROSS-REFERENCE TO RELATED APPLICATIONS

This application claims the benefit of U.S. Provisional Patent Application Ser. No. 61/250,555, filed on Oct. 11, 2009, the contents of which are incorporated herein by reference thereto.

BACKGROUND OF THE INVENTION

APPLES to APPLES® is a popular card game with children and adults. It combines aspects of chance found in all card games with player intellect and social skills to provide amusement to all players involved.

In one embodiment of the game, each player is dealt seven "red apple" cards. Each of those cards includes a noun or noun phrase printed thereon. One of the players is initially determined to be the judge for the first round. The judge draws a "green apple" card. The "green apple" card includes an adjective printed thereon. The "green apple" card is placed face-up on the playing surface so that every player can see it. Each player, with the exception of the judge, chooses a card from their own seven card hand that they think is the best match for the "green apple" card. Those cards are placed face-down.

The judge then shuffles the "red apple" cards that have been discarded by the players, reads them aloud and/or shows the other players those cards and then decides which noun on the "red apple" cards best matches the adjective shown on the face-up "green apple" card. A match, is simply the noun that is the favorite word to go with the adjective. While the other players may disagree with the choice, the decision is solely that of the judge for the particular hand—and the judge may make his decision on any basis he or she deems appropriate.

The player who submitted the chosen "red apple" card wins the round, and takes the "green apple" card as an indication of the win for that round. Each player then draws a new "red apple" card to replace the card discarded. The judge is rotated is then rotated to another player. The new judge may be the winner of the last round or may simply pass to the next player on a rotational basis.

The winner of the game is the first player to obtain a predetermined number of green apple cards. A more detailed description of related gameplay concepts is provided in U.S. Pat. No. 6,328,308, which is hereby incorporated by reference in its entirety.

SUMMARY OF THE INVENTION

An educational card game to provide amusement to players is disclosed. In one aspect of a disclosed embodiment, a card game is provided. It includes a plurality of game cards and a multifaceted die having a plurality of characters on the faces of said die. A rule set is also provided. It includes a plurality of rules, one of the rules of directing that a player identify an adjective that corresponds with one of a plurality of characters on an upturned face of said multifaceted die.

In another aspect of a disclosed embodiment, a method of playing a card game is also provided. It includes dealing a plurality of cards to a plurality of players and rolling a multifaceted die having a plurality of letters imprinted on the faces. An adjective that begins with one of the plurality of letters on an upturned face of the multifaceted die is identified by a player or judge. Each player, generally with the exception of the judge, chooses one card that complements the identified adjective. From the cards chosen, a single card that most closely represents the identified adjective is selected. A point or other reward is awarded to the player whose card was selected as most closely complementing or matching the identified adjective.

In yet another aspect of a disclosed embodiment, a plurality of game cards is provided. Each of the plurality of cards has a first face and a second face, one the faces imprinted with a noun. A multifaceted die having at least one letter character on a plurality of the die faces is included. A game board is provided. It includes a top panel, the top panel including a first portion for a first set of the plurality of game cards during game play, a second portion for a second set of the plurality of game cards for game play, and a third tray portion for rolling the multifaceted die during game play. An access door adapted to open and close an interior portion of the game board is provided. The interior portion is adapted to store the plurality of game cards and the multifaceted die when the game is not being played.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
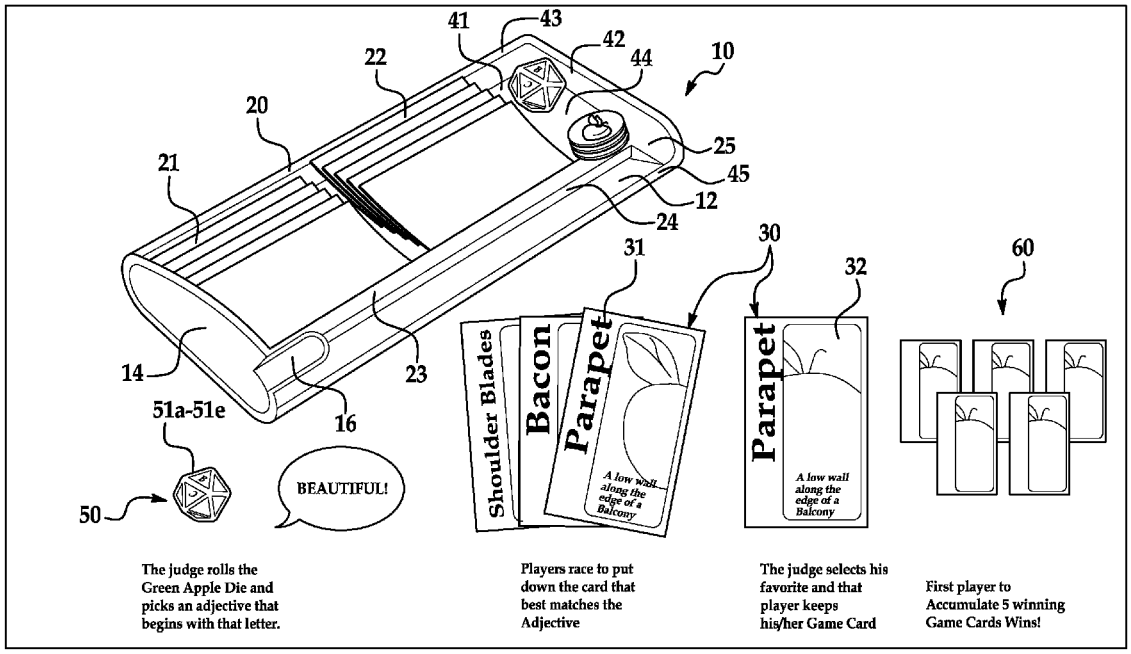
FIG. 1 is a pictorial view showing various aspects of the card game in accordance with the invention.

Referring now to the Figures, where exemplary embodiments of the present invention are illustrated, and in particular to FIG. 1, where various embodiments of the invention will be described with reference to specific embodiments, without limiting same, a card game 10, capable of being carried in a modular case 12 is shown. Modular case 12 includes and interior portion (not shown) capable of storing the contents of the game 10 when game 10 is not in use. The interior portion is accessed by access door 14 that is slidably removable from modular case 10 via the use of a thumb latch 16.

Modular case 12 includes a top panel 20 having a first portion 21 capable of retaining at least a first set of game cards 31 and a second portion 22 capable of retaining a second set of game cards 32. Adjacent first and second portions 21 and 22 are first and second finger depressions 23 and 24, respectively. Finger depressions 23 and 24 allow game players to easily obtain a card from either of first set of game cards 31 or second set of game cards 32 during game play. A finger or thumb of a game player is inserted in either of the depressions 23, 24 to hold one or the other set of game cards 31, 32 in place while the other of a finger or thumb slides the top card from the first or second set of game cards 31, 32.

A third tray portion 25 is located on top panel 20 and is adjacent second portion 22. Third tray portion 25 is recessed from the remainder of top panel 20 and is defined by a first side wall 41 adjacent second portion 22 and a second side wall 42 opposed to first side wall 42 and generally parallel thereto. First and second side walls 41 and 42 are connected by a rear sidewall 43 which is generally orthogonal to first and second side walls 41 and 42. The bottom 44 of third tray portion 25 is open to a front side 45 of modular case 12 to allow access to the recess of third tray portion 25 to facilitate game play, as will be described hereinafter.

Card game 10 includes a deck of game cards 30, comprised of the aforementioned first set of game cards 31 and second set of game cards 32. In an exemplary embodiment, there are one hundred and twenty game cards in each deck of game cards 30. Each individual game card includes a first card side or first face and a second card side or second face. The first side is imprinted with a picture or design. In the exemplary embodiment shown, the design is a red apple, thus giving name to the deck of game cards 30 being referred to as "red apple" game cards. The second side of each individual game card is imprinted with a noun, together with a short definition of the noun. It will be appreciated that the definition of the noun may be omitted in other exemplary embodiments. It is provided to enhance and facilitate game play. The game cards may alternatively include generally noun-based phrases, e.g., shoulder blades.

The nouns or noun-based phrases imprinted on the game cards may be comprised of any noun in the English language. In other exemplary embodiments (not shown) the nouns may be selected from other non-English languages to facilitate game play in any language in which game players wish to play the game.

In the exemplary embodiment shown, card game 10 is also provided with a multifaceted die 50. In the embodiment of FIG. 1, die 50 comprises twenty separate sides, side 51*a* through 51*e* being shown in FIG. 1. It will be appreciated that a die having more or less sides than the twenty shown of die 50 may be substituted in the game that is described herein. Each of the separate sides of die 50 is imprinted with a single character. The imprinted character may be a letter or a figure or be imprinted with a character or word indicative of any or all letter characters, defined herein as the "Wild" side. If the "Wild" side appears, the players or the judge as indicated below, may choose any word for game play and are not limited by the single letter as it appears on other faces of the die 50. In the embodiment shown, only one side is imprinted with a character or word indicative of the "Wild" side. It will be appreciated that in other embodiments, additional sides may be imprinted with a character that signifies a "Wild" side or, alternatively, one or more sides of the die 50 may be imprinted with multiple letters to choose from for game play.

In a non-limiting exemplary embodiment, shown in FIG. 1, players use their winning "red apple" game cards from the deck of game cards 30 to signify a winning point, as will be described hereinafter. In another non-limiting embodiment, card game 10 is provided with approximately twenty-one green apple chips. Green apple chips are awarded to the game player who has the winning card. In yet another alternative embodiment, players use alternative methods of keeping score of the card game 10, such as a tally sheet.

A Rule set is provided as part of the game 10 and, in one exemplary embodiment, appears as shown in Table 1.

TABLE 1

| |
|---|
| Deal a plurality of cards to a plurality of players |
| Select a Judge from the plurality of players |

TABLE 1-continued

| |
|---|
| The Judge rolls a multifaceted die having a plurality of letters imprinted thereon |
| The Judge identifies an adjective that begins with one of said plurality of letters on an upturned face of said multifaceted die |
| The other players choose and play one card that closely complements or matches the identified adjective |
| The Judge determines from the cards played a single card that most closely represents the identified adjective |
| The Judge awards a point to one of the plurality of players that played the single card |
| The other players draw a new card to replace the played card |
| Select a new Judge and Repeat play until one player obtains a predetermined number of points |

Figure 2:
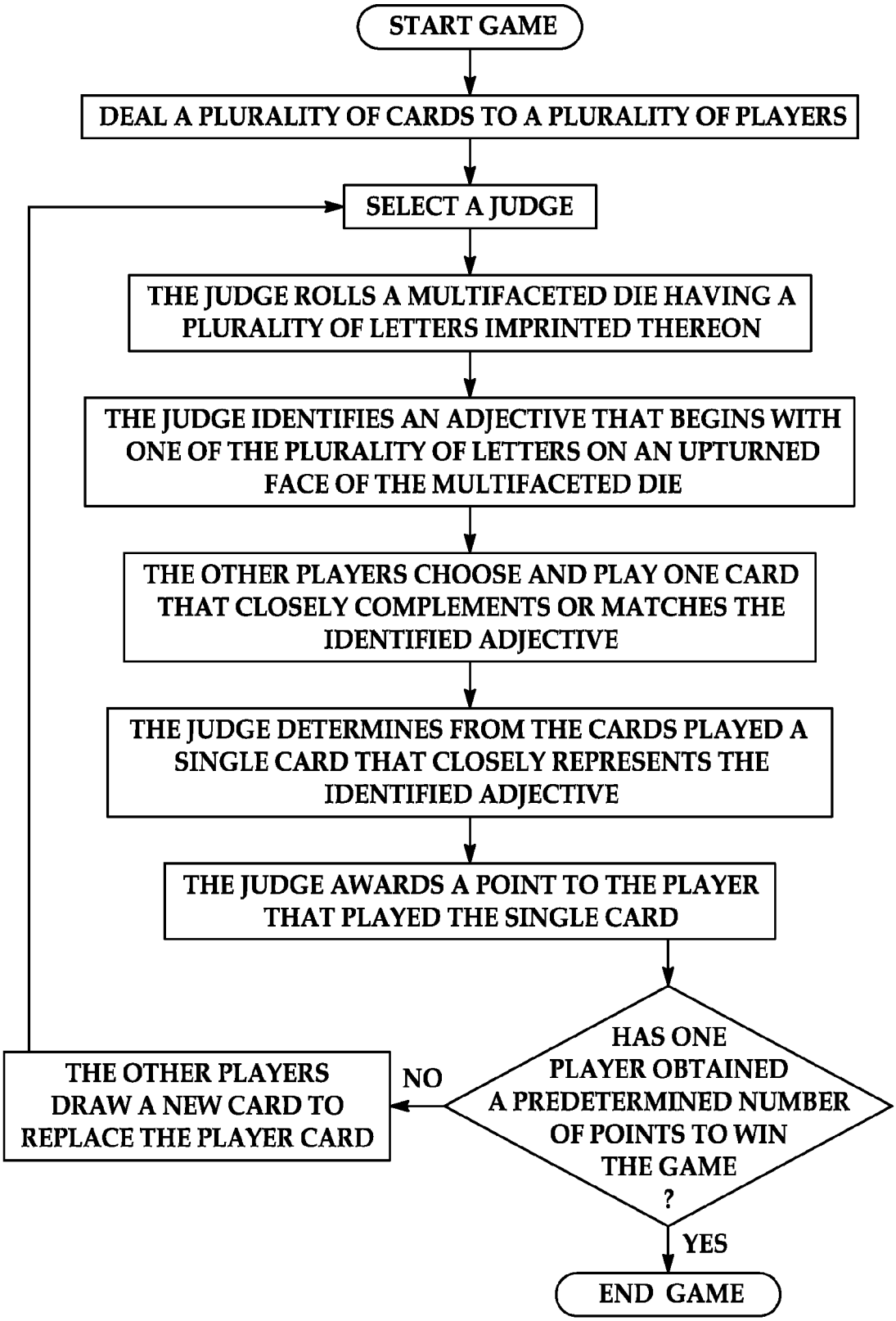
FIG. 2 is a diagram showing one exemplary embodiment of the card game in accordance with the invention.

In an exemplary embodiment, and in accordance with FIG. 2, the card game 10 is played as described hereinbelow. Between three and five game players are assembled. One of the game players is selected as the initial dealer and judge. The judge then deals five game cards 30 to each of the game players including himself or herself. The remaining cards are then placed on first portion 21 of top panel 20 to become the first set of game cards 31.

The judge then rolls the die 50 in third tray portion 25 so that a single letter appears on the uppermost portion of the sides 51 when the die stops rolling. The judge then selects an adjective that begins with the letter shown. For example, as shown in FIG. 1, if the letter "B" appears on the uppermost side 51 of die 50, then the judge may choose any adjective beginning with "B". In the example shown, the judge has selected the word "Beautiful" as the adjective. Once the word is verbally announced by the judge, the other game players review the five game cards 30 in their own hand that each contain a separate noun. Each of the other game players select one of the five game cards in their hand that they have selected because they feel the noun thereon best complements or matches the adjective announced. The selected card is placed face down, i.e. the first side is up, in a front of the judge. The judge picks up the cards and shuffles them to insure that he or she does not know the identity of the game player who discarded that game card.

The judge then reviews each of the game cards 30 in his or her hand and selects that card which he or she feels best matches the adjective selected. In the example shown in FIG. 1, the three remaining game players selected cards with the nouns "shoulder blades", "bacon" and "parapet". The judge selected the card with the word "parapet". The game player who submitted the card containing the word "parapet" is awarded one point. The used game cards are placed on second portion 22 of top panel 20, to form second set of game cards 32, in order that they do not get used again in the game. The winning game card is retained by the player awarded one point, to signify the one point. Each player, except the judge, then draws a new game card 30 from the first set of game cards 31 sitting on first portion 21 of top panel 20.

In another exemplary embodiment, the winning point may be signified by awarding a green apple chip, as described above. In other embodiments, the players may keep score with a simple tally sheet or any other known means of keeping score. The first player to obtain five points, or five winning "red apple" game cards 60, wins the game.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention, including for example those disclosed and described in U.S. Pat. No. 6,328,308. Additionally, while various embodiments of the invention have been described, it is to be understood that aspects of the invention may include only some of the described embodiments. Accordingly, the invention is not to be seen as limited by the foregoing description.

Having thus described the invention, it is claimed:

1. A card game comprising;

a plurality of game cards, each of the plurality of cards having a first face and a second face, the second face imprinted with a noun;

a multifaceted die having at least one letter character on each one of a plurality of die faces;

a modular case having a top panel, the top panel including a first portion for a-a first set of the plurality of game cards during game play, a second portion for a second set of the plurality of game cards during game play, a third tray portion for rolling the multifaceted die during game play; and an access door adapted to open and close an interior portion of the modular case, the interior portion adapted to store the plurality of game cards and the multifaceted die when the game is not being played, wherein the access door is slidably removable from the modular case via a thumb latch.

2. The card game of claim 1, wherein the multifaceted die includes at least twenty faces and wherein the access door is located on an end portion of the modular case.

3. The card game of claim 2, wherein at least one face of the multifaceted die has a letter character indicative of all letter characters.

4. The card game of claim 3, wherein only one face of the multifaceted die has a letter character indicative of all letter characters.

* * * * *